US005613870A

United States Patent [19]

Traver, Jr.

[11] Patent Number: 5,613,870

[45] Date of Patent: Mar. 25, 1997

[54] POSITIVE LATCHING CONNECTOR WITH DELATCHING MECHANISM

[75] Inventor: Robert F. Traver, Jr., Landenberg, Pa.

[73] Assignee: W. L. Gore & Associates, Inc., Newark, Del.

[21] Appl. No.: 563,324

[22] Filed: Nov. 28, 1995

[51] Int. Cl.[6] ..... H01R 13/627

[52] U.S. Cl. ..... 439/352; 439/357

[58] Field of Search ..... 439/350, 352, 439/355, 357, 358, 571, 572

[56] References Cited

U.S. PATENT DOCUMENTS

| | | | |
|---|---|---|---|
| 5,318,457 | 6/1994 | Harting et al. | 439/357 X |
| 5,435,744 | 7/1995 | Derstine et al. | 439/352 |
| 5,449,298 | 9/1995 | Fetterolf, Sr. et al. | 439/350 X |
| 5,518,416 | 5/1996 | Kantner et al. | 439/352 |

OTHER PUBLICATIONS

Catalog: AMP-.025 Square Interconnection System (AMP-MODU), Catalog 82187, Streamlined Mar. 1989, pp. 42–43.

*Primary Examiner*—Khiem Nguyen

*Attorney, Agent, or Firm*—Victor M. Genco, Jr.

[57] ABSTRACT

An improved electrical connector is provided for selectable mating with an electrical apparatus. The improved electrical connector is defined by a latch assembly, a connector housing, and a handle assembly. The latch assembly is mounted to the electrical apparatus. The connector housing includes physical features which allow for positive latching to the latch assembly, and which allow for the moveable attachment of the handle assembly to the connector housing. To intentionally disengage the electrical connector from the electrical apparatus, a user applies a pulling force on the handle assembly, whereupon the connector housing disengages from the latch assembly. However, if a pulling force is applied to the connector housing, or individual electrical cables, unintentional disengagement of the connector housing from the latch assembly is prevented.

13 Claims, 5 Drawing Sheets

36
12
14
F
26
40

36
12
58
58

36
12

36
12
P 36
12

36
12
U

POSITIVE LATCHING CONNECTOR WITH DELATCHING MECHANISM

FIELD OF THE INVENTION

This invention generally relates to the field of electrical cable interconnection. More particularly, the present invention relates to an improved positive latching electrical connector having a delatching mechanism.

BACKGROUND OF THE INVENTION

In recent years, a trend present in the electronics industry has been to package electronic cables in extremely dense interconnection arrangements. This increase in density has come at the expense of other requirements for cable interconnections, for example electrical fidelity, mechanical reliability, and overall cost.

A cornerstone in the design of a cable connector system is to provide for effective mechanical reliability. More particularly, it is necessary to incorporate a positive latching device with a cable connector system to eliminate inadvertent unplugging of the cable connector system from a mating connector system. Of course, by definition, a cable connector system must provide for selectable unplugging. Therefore, any device that will eliminate inadvertent unplugging, must also be easily defeated when the cable connector system is to be intentionally unmated.

One design which has been employed in the past to prevent inadvertent unplugging of the connector is a "detent" or "semi-positive" latching arrangement. Such a design requires a dual ramped bump, or protuberance, on a first surface of a first connector, and a matching "window" or "detent" on a surface of a mating second connector. Upon insertion of the first connector, the leading edge of the bump is gently sloped and "pops" into the detent on the mating second connector. However, upon unmating, the trailing edge of the bump is more aggressively ramped, and requires a much greater force to "pop" out of the detent. A shortcoming of such a design is that this type of semi-positive latching design is defeated by a force slightly greater than the unplugging force of the connector, which results in inadvertent connector disengagements.

Another approach employed in the electronics industry to provide positive latching is typified in the "latch and eject" style of a header assembly which is defined by military standard MIL-C-83503. This type of interconnection scheme includes latches on either end of a male connector that perform two functions: 1) the latches provide positive latching of a female connector; and 2) the latches provide a lever to easily unmate the interconnection. A shortcoming of this type of connection scheme is that it requires a large amount of additional area to physically support the latches, and to permit the latches to move freely. For the same reasons that the electronics industry is requiring more dense cable interconnection arrangements, additional area to support such a latch arrangement is not readily available.

Another design employed in the electronics industry to increase the mechanical reliability of a cable interconnection arrangement requires that the cables be terminated to a stamped and formed metal contact that has a feature which grips the mating pin when a pulling force is applied to the cables. These metal contacts are grouped in a thermoplastic connector housing in such a fashion that the contacts are allowed to move slightly within the housing. To unmate the connector from the mating pins, a predetermined pulling force is exerted on the housing. A shortcoming of such a design is that if a load is applied to a cable, or cables, while a user attempts to unmate the connector housing from the mating pins, the loaded cable(s) will cinch tightly on the respective pin(s), and disengagement of the connector housing will be prevented. Also, although such a design does readily permit a connector system to plug into confined space arrangements, in a desired unmating evolution of this type of connector system in a confined space, an operator must be able to grip the connector housing, which is extremely difficult.

The foregoing illustrates limitations known to exist in present cable connector arrangements. Thus, it is apparent that it would be advantageous to provide an improved cable connector system directed to overcoming one or more of the limitations set forth above. Accordingly, a suitable alternative is provided including features more fully disclosed hereinafter.

SUMMARY OF THE INVENTION

The present invention advances the art of electrical connectors beyond which is known to date. In one aspect of the present invention, an electrical connector comprises a housing, a handle assembly and a latch assembly. The housing has formed therein a plurality of cavities, each of which is dimensioned to receive an electrical conductor assembly. The housing has a front portion having formed therein a plurality of apertures, each of which is dimensioned to receive a contact pin of the electrical apparatus. The housing defines a pair of lateral portions. Each lateral portion has formed thereon a latching member. The handle assembly has a gripping portion and an attaching portion. The attaching portion is defined, at least in part, by a pair of arms which each terminate with an engaging head member. The handle assembly is moveably attachable with the housing. The handle assembly is moveable, back and forth, from a first delatching position to a second latching position. The latch assembly is defined by at least one base portion and a pair of arms. Each arm defines a first receiving portion for receiving a respective latching member and a second receiving portion for receiving a respective engaging head member.

BRIEF DESCRIPTION OF THE DRAWINGS

The foregoing summary, as well as the following detailed description of a preferred embodiment of the invention, will be better understood when read in conjunction with the appended drawings. For purposes of illustrating the invention, there is shown in the drawings an embodiment which is presently preferred. It should be understood, however, that the invention is not limited to the precise arrangement and instrumentality shown. In the drawings.

DETAILED DESCRIPTION OF THE INVENTION

Figure 1:
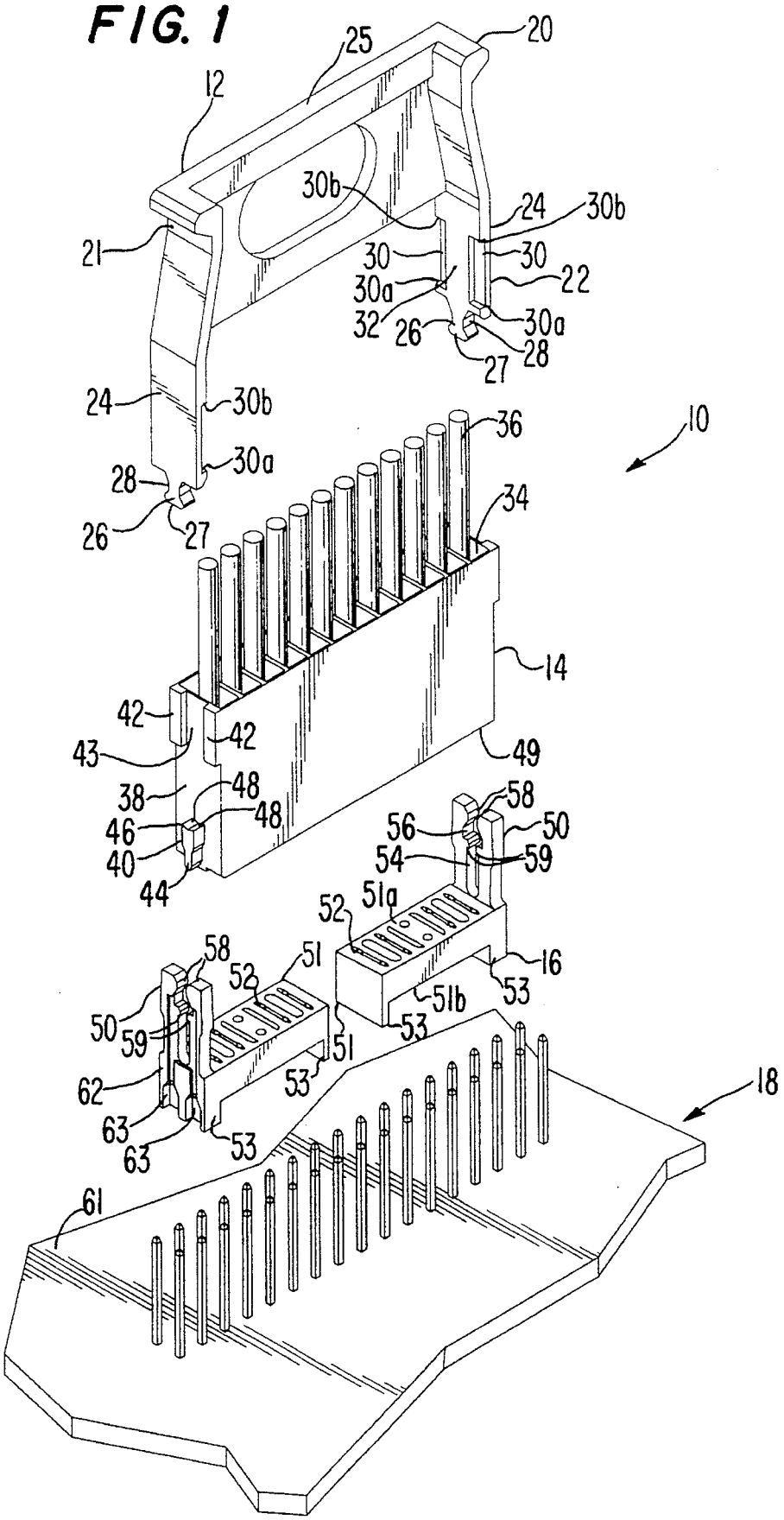
FIG. 1 is an exploded, environmental view of the positive latching connector, having a delatching mechanism, of the present invention.

Referring now to the drawings, wherein similar reference characters designate corresponding parts throughout the several views, the positive latching connector of the present invention is generally illustrated at 10 in FIG. 1. The positive latching connector 10 includes a handle assembly 12, a connector housing 14, and a latch assembly 16, which may all be formed from a suitable engineering grade thermoplastic. Suitable engineering grade thermoplastics include, but not limited to, a thermoplastic polyester polymer, polyphenylene sulfide, polyamide, acetyl, acetylene-butadiene-styrene terpolymer, polytetrafluoroethylene, polyvinyl chloride, polypropylene, polyethylene, polyethylene terephthalate (PET), polybutyline terephthalate (PBT), polycarbonate, polyether imide or liquid crystal polymer (LCP). The positive latching connector 10 is operable for electrical connection with an electrical apparatus 18.

The electrical apparatus 18 may be a printed circuit board having a plurality of electrical connector pins 60 made integral therewith.

As best understood by reference to FIG. 1, the handle assembly 12 is a one-piece construction having an upper gripping portion 20 and a lower attaching portion 22. The handle assembly 12 is defined by a pair of arms or side members 24 and a cross support 25. The upper gripping portion 20 is suitably dimensioned to enable a user to exert a gripping or pulling force thereupon. Lateral surfaces 21 of the upper gripping portion 20 may have formed thereon a plurality of grooves or ridges (not shown) for facilitating the gripping of the handle assembly by the user. The lower attaching portion 22 is defined at a lower portion of the arms 24. More particularly, the lower portion of each arm 24 defines an engaging head 26, a pair of travel or rail slots 30, and an engaging tab member 32. Each engaging head 26 defines a leading edge portion 27 and a shaft portion 28. Each engaging tab member 32 is a raised elongated protuberance formed on an interior surface of each arm 24. The engaging tab members 32 are substantially rectangularly shaped, and are disposed parallel with a respective arm 24. Rail slots 30 are formed parallel with lateral edge surfaces of each engaging tab member 32. Rail slots 30 terminate at stops 30*a* and 30*b*. Stops 30*a* and 30*b* limit the travel of the handle assembly 12, with respect to the connector housing 14, as will be described in further detail hereinafter.

The connector housing 14 has formed therein a plurality of cavities 34 within which electrical conductor assemblies 36 are terminated and held firmly. The connector housing 14 defines lateral portions 38 which each have formed thereon a latching wedge 40 and a pair of rails 42. Rails 42 define a travel slot 43. Latching wedge 40 is defined by a latching wedge head portion 44 and latching wedge trailing edge portion 46. In a preferred embodiment, the latching wedge trailing edge portion is defined by inwardly converging surfaces 48. A front portion 49 of connector housing 14 has formed therein a plurality of apertures (not shown) which insertably receive a plurality of pins 60 of the electrical apparatus 18.

The latch assembly 16 may be a one-piece assembly (not shown), or may be a two-piece assembly as shown in detail in FIG. 1. The embodiment of the latch assembly 16 which is illustrated in FIG. 1 is defined by a pair of latching arms 50 and a pair of base portions 51. (In a one-piece embodiment of the latch assembly 16, the latch assembly will be defined by a pair of latching arms 50 and a single base portion 51.) Each base portion 51 includes a top surface portion 51*a* and a bottom portion 51*b*. Formed perpendicularly through the base portion 51, with respect to the top and bottom surfaces thereof, are a plurality of slots, the function of which will be described in detail hereinafter. Formed on the bottom surface 51*b* of the base portion 51 may be a pedestal assembly 53 which elevates the base portion 51 above a surface 61 of the electrical apparatus 18. As should be understood, the pedestal portion 53 is not an essential feature of the base portion 51.

The latch assembly 16 is fixedly attachable with the electrical apparatus 18. Broadly, a mounting means 52 is provided to fixedly attach the latch assembly with the electrical apparatus 18. The mounting means 52 may be defined by rivets, screw fasteners, press fitting members or any other suitable mounting means. In a preferred embodiment, slots 52 are provided for pressfittingly engaging respective pins 60.

Each latching arm 50 defines a first receiving portion 54 and a second receiving portion 56. Each first receiving portion 54 receives a respective latching wedge 40 of the connector housing 14. At one end thereof, each first receiving portion 54 terminates with a pair of latching wedge locking surfaces 59, which are engagable with the latching wedge trailing edge 46 to lock the latching wedge 40 within the first receiving portion 54. Formed on each of the latching arms 50 are a pair of cams 58. Exterior surfaces 62 of the latching arms 50 may have formed therein grooves or channels 63, which are dimensioned to receive individual pins 60.

Figure 5:
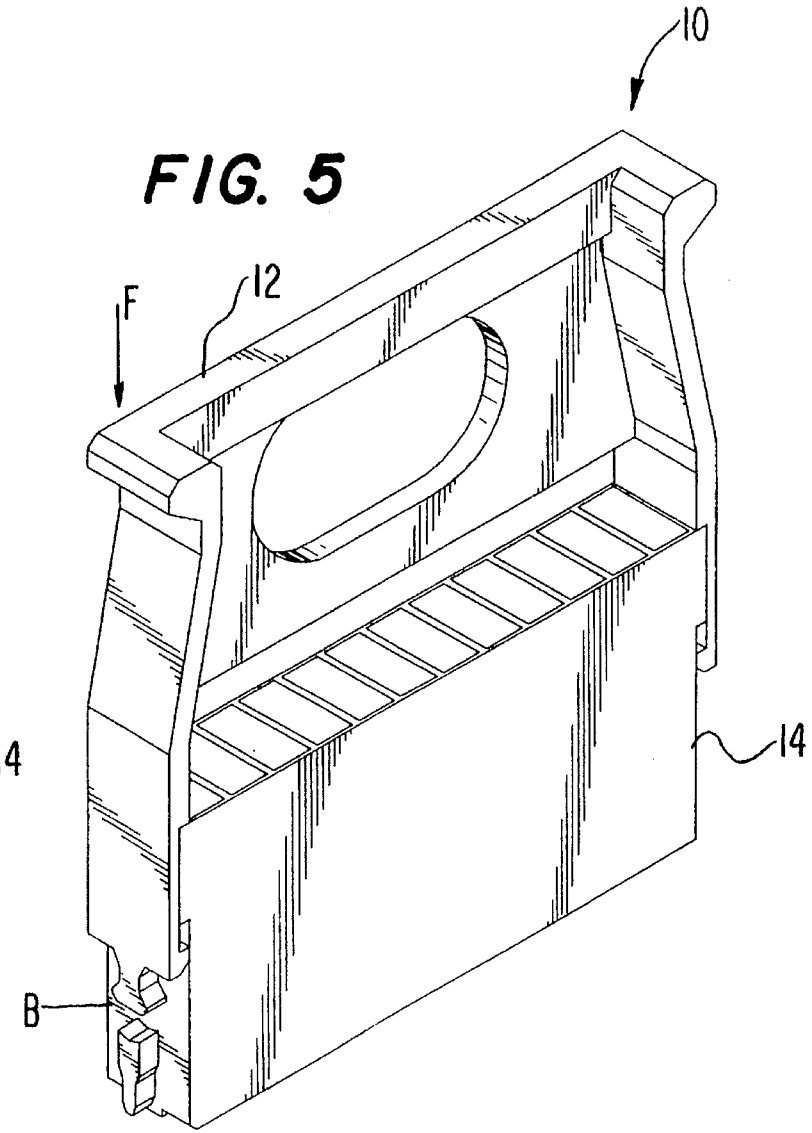
FIG. 5 is a perspective view of the invention of FIG. 1, wherein the unmating handle is illustrated in a second latching position.
Figure 4:
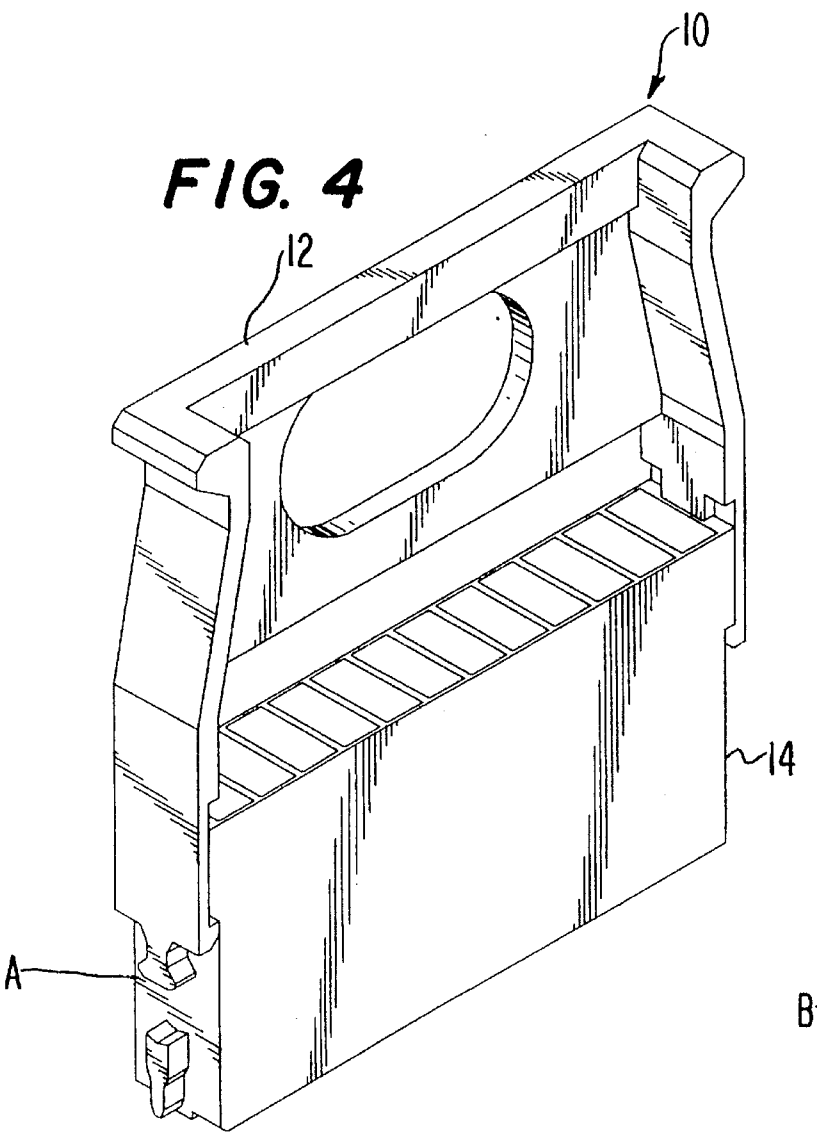
FIG. 4 is a perspective view of the invention of FIG. 1, wherein an unmating handle is illustrated in a first delatching position.

As best understood by comparing FIG. 4 and FIG. 5, the handle assembly 12 "floats", or is otherwise slidably movable, relative to the connector housing 14. More particularly, the handle assembly 12 is operable for travel between a first position A (delatching position), which is shown in FIG. 4, and a second position B (latching position), which is shown in FIG. 5. This limited travel is directed by the interaction of a pair of rails 42, which move within respective rail slots 30, and an engaging tab member 32, which moves within a travel slot 43. Travel is limited between the first position A and the second position B by stops 30*a* and 30*b*.

Figure 3:
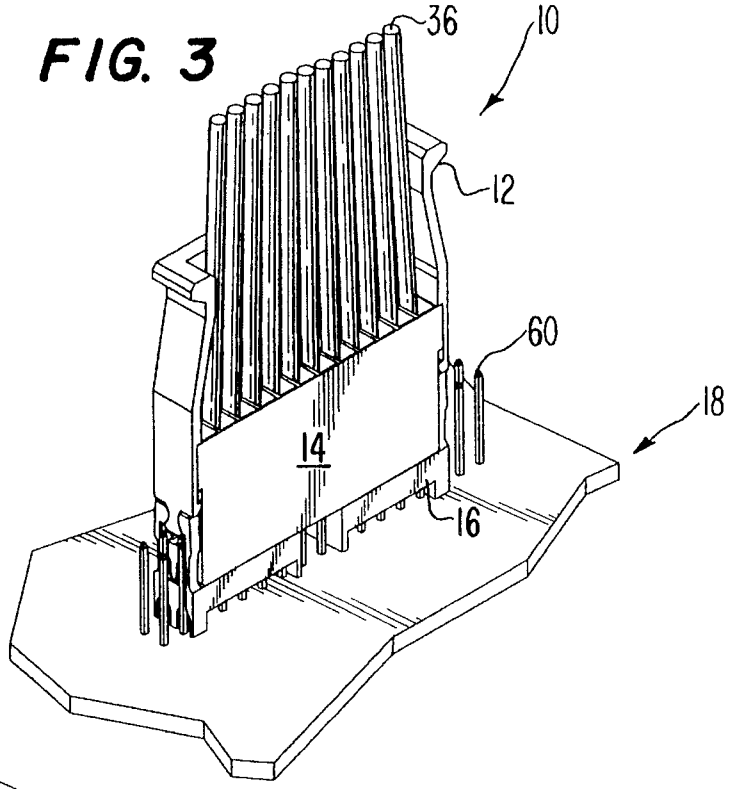
FIG. 3 is a perspective, environmental view of the invention of FIG. 1, wherein the positive latching connector is illustrated in a mated, or engaged, disposition with respect to the electrical apparatus.
Figure 2:
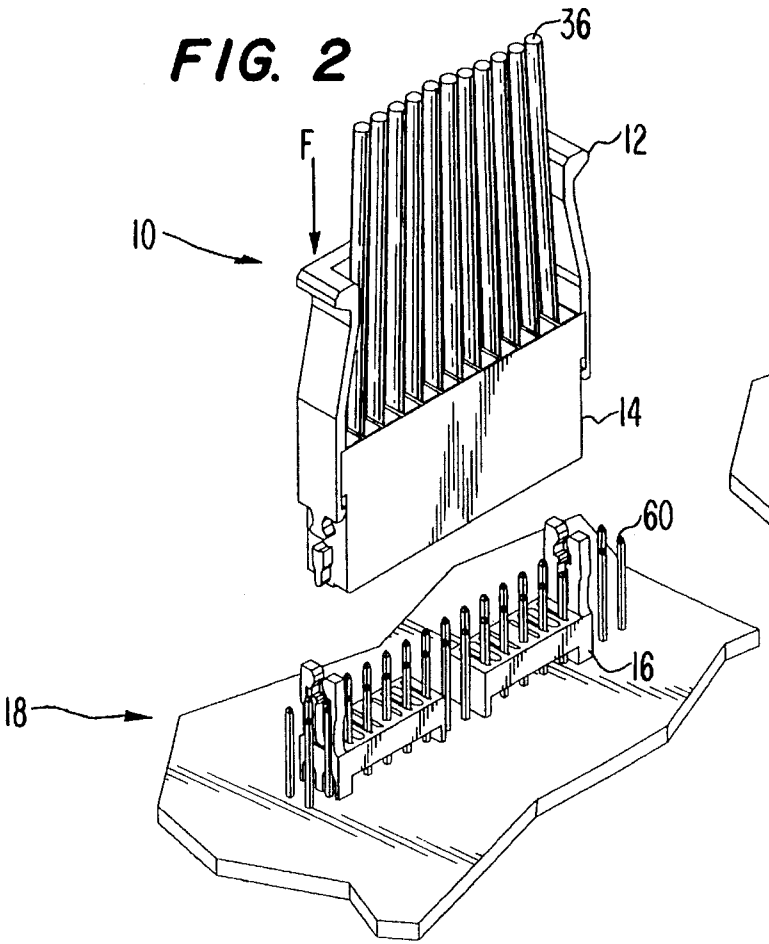
FIG. 2 is a perspective, environmental view of the invention of FIG. 1, wherein the positive latching connector is illustrated in an unmated, or disengaged, disposition with respect to an electrical apparatus.

As best seen by reference to FIGS. 2 and 3, an operator mates and unmates the positive latching connector 10 by way of the handle assembly 12. When mating the positive latching connector 10, an operator applies a mating force "F" to the handle assembly 12, which causes the handle assembly to move into the second position B. In this position, the engaging head 26 moves into close proximity to the latching wedge 40 on the connector housing 14. The handle assembly 12 will remain in this position until the connector housing is fully seated within the latch assembly 16. The mated and latched connector 10 is best illustrated by reference to FIG. 3.

Figures 7A, 7B, 7C, 7D, 7E, 7F:
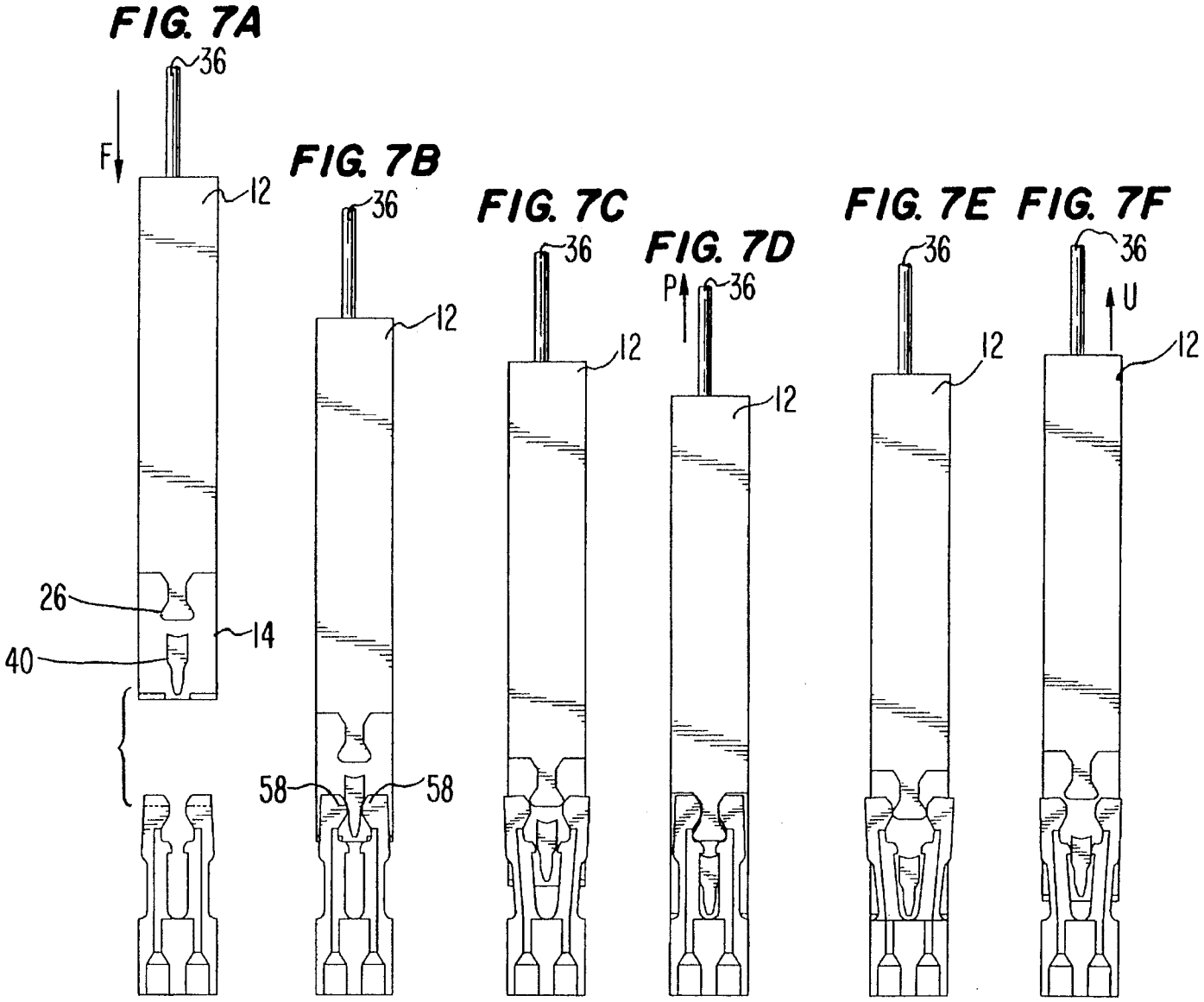
FIGS. 7A, 7B, 7C, 7D, 7E, 7F illustrate a typical mating and unmating sequence for the positive latching connector of the present invention.

Operation of the positive latching connector 10 of the present invention is best understood by reference to FIGS. 7A through 7F, which illustrate a side view of the apparatus of the present invention during a mating and unmating sequence. Referring to FIG. 7A, an operator provides a mating force "F" to the handle assembly 12. The mating force "F" causes the handle assembly 12 to move from the first position A, to the second position B, wherein the engaging head 26 is disposed in close proximity to the latching wedge 40. As seen in FIG. 7B, as the mating force "F" is continued to be applied to the handle assembly 12, the latching wedge 40 of the connector housing 14 begins to engage the cams 58 of the latch assembly 16. Such an arrangement permits the connector housing 14 to be aligned with the latch assembly 16 prior to engagement of the connector housing 14 with the pins 60, thereby reducing any risk of pin damage upon connector mating. In FIG. 7C, the mating force "F" is continued to be provided such that the connector housing 14 and handle assembly 12 continue to engage the latch assembly 16. As illustrated in FIG. 7C, the engaging head 26 has engaged the cams 58 whereby the latching arm 50 is separated in such a way to permit the latching wedge 40 to slide past the latching wedge locking surface 59, and into the first receiving portion 54. This progression will continue until the connector housing 14 is fully mated with the electrical apparatus 18, at which time the latching wedge 40 will be disposed completely within the first receiving portion 54. When fully mated, the latching wedge 40 will be locked in a predetermined fixed position by engagement of the latching wedge trailing edge 46 with the latching wedge locking surface 59, and the engaging head 26 will be fully seated within the second receiving portion 56. The fully mated connector 10 is illustrated in FIG. 7D. As shown therein, if an inadvertent force "P" is applied to any of the electrical conductor assemblies 36, the force will be transferred from the electrical conductor assembly to the connector housing 14, and to the latching wedge 40. Because the latching wedge 40 is fully engaged under the latching wedge locking surface 59, the connector housing 14 is prevented from being inadvertently unmated from the electrical apparatus 18. When intentional unmating of the positive latching connector 10 is desired, an operator provides an unmating force "U" upon the handle assembly 12. The unmating force "U" causes the handle assembly 12 to move into the first position A (the delatching position). As the handle assembly travels into the first position A, the engaging head 26 slides along the cams 58, which causes opposed sides of the latching arm 50 to open and release the latching wedge 40 from the latching wedge locking surfaces 59. Continued application of the unmating force "U" causes the latching wedge 40 to slide past the latching wedge locking surfaces 59 and the cams 58 until the positive latching connector 10 is completely unmated.

Figure 6:
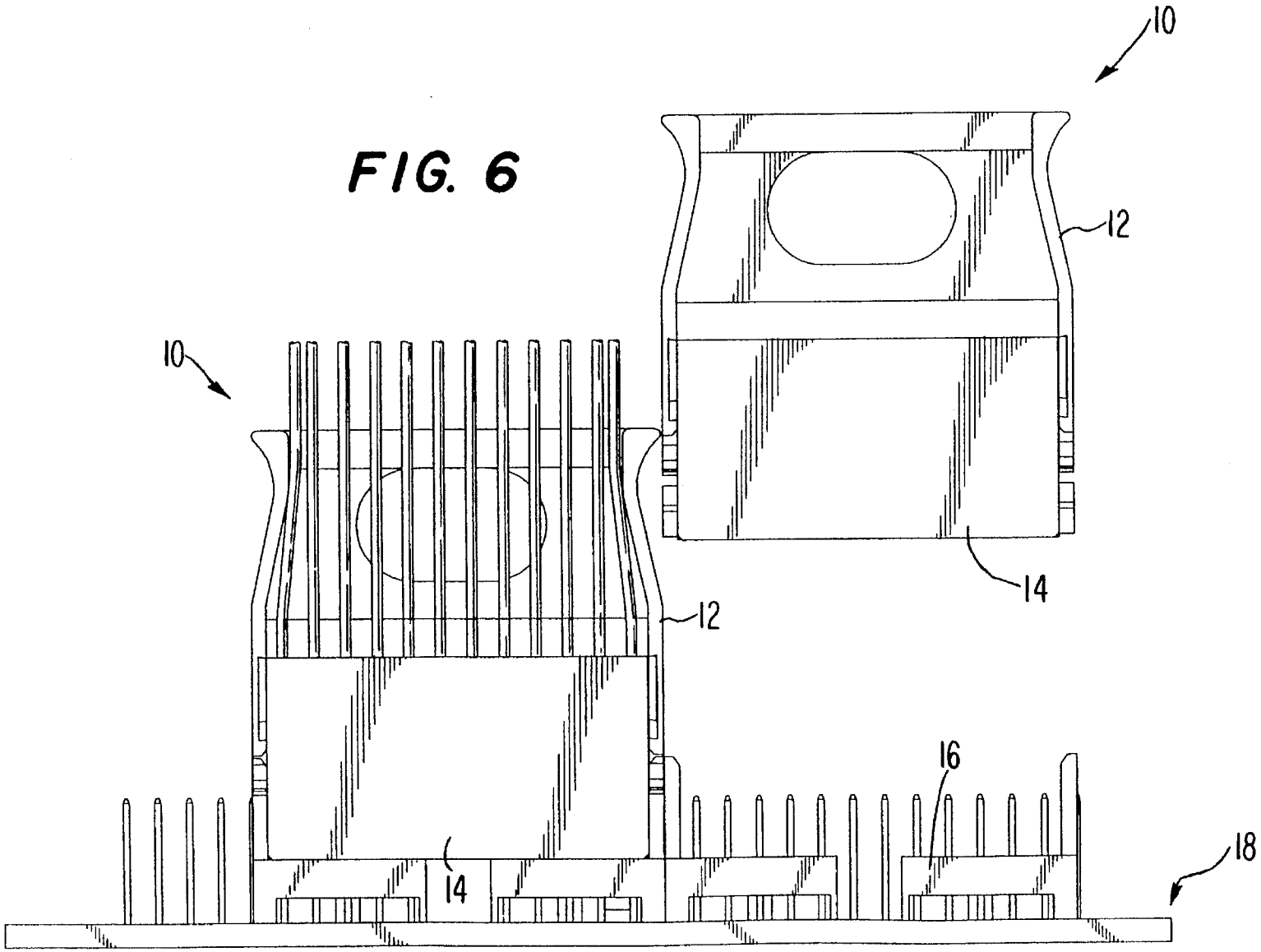
FIG. 6 is an environmental view of a pair of positive latching connectors of the present invention oriented in a side-by-side mounting configuration.

Because of the reliance on the elasticity of the material comprising the latch assembly 16, rather than an additional latching member, the design of the present invention lends itself to a denser than typical packaging arrangement. The design of the present invention permits connector assemblies to be mounted both end-to-end, and side-to-side on standard pin grid arrays with minimal loss of pins. For example, as illustrated in FIG. 6, two positive latching connectors 10 are mounted end-to-end, adjacent to one another. Only two pins 60 are lost for connection purposes. As should be understood, the pins 60 are disposed within the channels 63, which are formed on the exterior surfaces 62 of the latching arms 50.

Although a few exemplary embodiments of the present invention have been described in detail above, those skilled in the art readily appreciate that many modifications are possible without materially departing from the novel teachings and advantages which are described herein. Accordingly, all such modifications are intended to be included within the scope of the present invention, as defined by the following claims.

Having described the invention, what is claimed is:

1. A connector for mating with an electrical apparatus, the connector comprising:

a housing having formed therein a plurality of cavities, each of which is dimensioned to receive an electrical conductor assembly, the housing having a front portion having formed therein a plurality of apertures, each of which is dimensioned to receive a contact pin of the electrical apparatus, the housing defining a pair of lateral portions, each lateral portion having formed thereon a latching member;

a handle assembly having a gripping portion and an attaching portion, the attaching portion being defined, at least in part, by a pair of arms which each terminate with an engaging head member, the handle assembly being moveably attachable with the housing, the handle assembly being moveable, back and forth, from a first delatching position to a second latching position; and a latch assembly defined by at least one base portion and a pair of arms, each arm defining a first receiving portion for receiving a respective latching member and a second receiving portion for receiving a respective engaging head member.

2. The invention of claim 1, wherein each lateral portion of the housing has formed thereon a pair of rails which define a first slot, and wherein each arm has formed on an interior arm surface a tab member, wherein a respective tab member is positioned within a respective first slot when the handle assembly is moveably attached with the housing.

3. The invention of claim 1, wherein the latching member is wedge shaped having a leading edge portion and a trailing edge portion.

4. The invention of claim 3, wherein the trailing edge portion is defined by inwardly converging surfaces.

5. The invention of claim 2, wherein each arm has formed on the interior arm surface a pair of rail slots, each one of the rail slots being disposed along a respective lateral edge of the tab member, wherein the first and second rails of each respective pair of rails are positioned within respective rail slots when the handle assembly is moveably attached with the housing.

6. The invention of claim 5, wherein at least one of the pair of rail slots defines first and second stops.

7. The invention of claim 1, wherein the latch assembly is fixedly attached with the electrical apparatus.

8. The invention of claim 1, wherein the latch assembly includes an attachment means for attaching the latch assembly with the electrical apparatus.

9. The invention of claim 8, wherein the electrical apparatus includes a plurality of contact pins.

10. The invention of claim 1, wherein the at least one base portion of the latch assembly includes a pedestal portion.

11. The invention of claim 1, wherein each arm of the latch assembly includes a pair of cams.

12. The invention of claim 1, wherein each first receiving portion of each arm includes a latching member locking surface.

13. The invention of claim 1, wherein an exterior surface of each arm of the latch assembly has formed therein a groove for receiving a predetermined pin of the electrical apparatus.

* * * * *